United States Patent [19]

Adorney

[11] 4,128,937

[45] Dec. 12, 1978

[54] SAFETY RAZOR WITH SERPENTINE HANDLE

[76] Inventor: Charles S. Adorney, 61 Mallard Dr., Greenwich, Conn. 06830

[21] Appl. No.: 712,398

[22] Filed: Aug. 6, 1976

[51] Int. Cl.[2] ..... B26C 21/22

[52] U.S. Cl. ..... 30/47; 30/48

[58] Field of Search ..... 30/47, 48, 50, 85, 26, 30/27, 329, 332, 340

[56] References Cited

U.S. PATENT DOCUMENTS

| | | | |
|---|---|---|---|
| 1,048,154 | 12/1912 | Harley | 30/48 X |
| 1,247,266 | 11/1917 | Hartman | 30/48 |
| 1,824,338 | 9/1931 | Finn | 30/48 |
| 3,783,510 | 1/1974 | Dawidowicz | 30/47 |

FOREIGN PATENT DOCUMENTS

| | | | |
|---|---|---|---|
| 375976 | 3/1907 | France | 30/48 |
| 628331 | 8/1949 | United Kingdom | 30/48 |

*Primary Examiner*—Gary L. Smith

*Attorney, Agent, or Firm*—Fitzpatrick, Cella, Harper & Scinto

[57] ABSTRACT

A safety razor having a handle assembly and a blade mounted thereon is disclosed. The handle assembly includes a gripping portion formed at one end thereof, a surface extending transversely of the center line of the handle assembly to define the other end of the assembly, and another surface for mounting the blade to the handle assembly so that the blade's cutting edge is at an acute angle with respect to the transverse surface and so that no part of the blade extends beyond the other end of the handle assembly.

7 Claims, 5 Drawing Figures

SAFETY RAZOR WITH SERPENTINE HANDLE

BACKGROUND OF THE INVENTION

1. Field of the Invention

This invention relates to safety razors and more particularly to a construction by which facial and other hair is removed by slicing same with a blade which has its cutting edge inclined at an oblique angle with respect to the razor handle.

2. Description of the Prior Art

Prior art safety razors have, for the most part, been constructed so that the cutting edge of the blade is mounted transversely of the handle. With this arrangement, the blade must chop through each hair and, because of the resistance to such chopping action, the blade actually pulls the hair in the direction of the shaving stroke. Accordingly, this construction has produced an uncomfortable shave for many individuals, particularly those with sensitive skin.

In order to overcome this problem, it has been suggested that the blade be mounted with its cutting edge at an oblique angle with respect to the handle so that the hair is sliced instead of chopped. Such a construction also provides a smoother transition between shaved and unshaved regions during the shaving stroke. It will therefore be appreciated that the cutting action of such a modified razor produces a much smoother shave with much less resistance.

However, attempts to market such modified razors have been unsuccessful; the reason being psychological. It has been found that when an individual uses such a razor, there is a natural tendency to pull the razor in a direction perpendicular to the cutting edge of the blade. Not only does this require the razor to be held in an awkward manner, but the purpose of the inclined construction is unconsciously defeated.

SUMMARY OF THE INVENTION

The present invention avoids the above-discussed disadvantages of the prior art by providing a safety razor having a blade mounted so that its cutting edge extends at an oblique angle with respect to a handle assembly having a transverse surface at its upper end. This upper end in effect hides the blade from the user so that there is no tendency to compensate for the inclination of the blade's cutting edge.

According to one aspect of the invention there is provided a safety razor having a blade and a handle assembly. The handle assembly has a gripping portion formed at one end and a surface extending transversely of the center line of the handle defining the other end thereof. The handle assembly also has means for mounting the blade member on the handle so that the blade's cutting edge extends at an acute angle with respect to the transverse surface and so that no part of the blade extends beyond the other end.

The term "blade" as used herein is intended to define either a cartridge containing one or more blade elements or a single blade element which may, for example, be of the injector type.

There has thus been outlined rather broadly the more important features of the present invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that this invention may be utilized as a basis for designing other structures for carrying out the several purposes of this invention. It is therefore important that the claims be regarded as including such equivalent constructions as do not depart from the spirit and scope of the invention.

BRIEF DESCRIPTION OF THE DRAWINGS

One embodiment of the invention has been chosen for purposes of illustration and description and is shown in the accompanying drawings forming a part of the specification, wherein.

DETAILED DESCRIPTION OF THE PREFERRED EMBODIMENT

As shown in FIGS. 1–5 the invention is embodied in a safety razor having a blade 1 mounted on a handle assembly including a head 2 and a gripping portion 3.

The gripping portion 3, which defines the lower end of the handle assembly, is an elongated member, shaped to provide a comfortable grip for shaving. It is preferably molded from plastic or the like.

Figure 2:
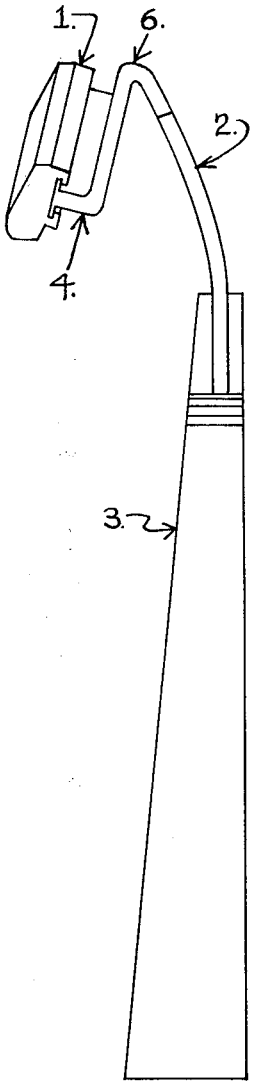
FIG. 2 is a side elevational view of the safety razor of FIG. 1.
Figure 4:
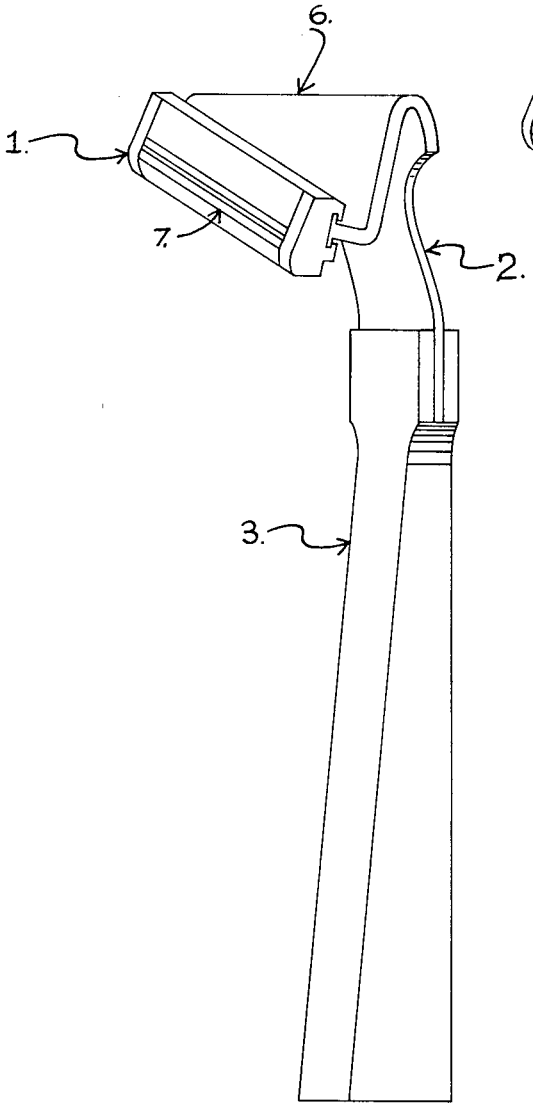
FIG. 4 is a perspective view of the safety razor of FIG. 1.
Figure 5:
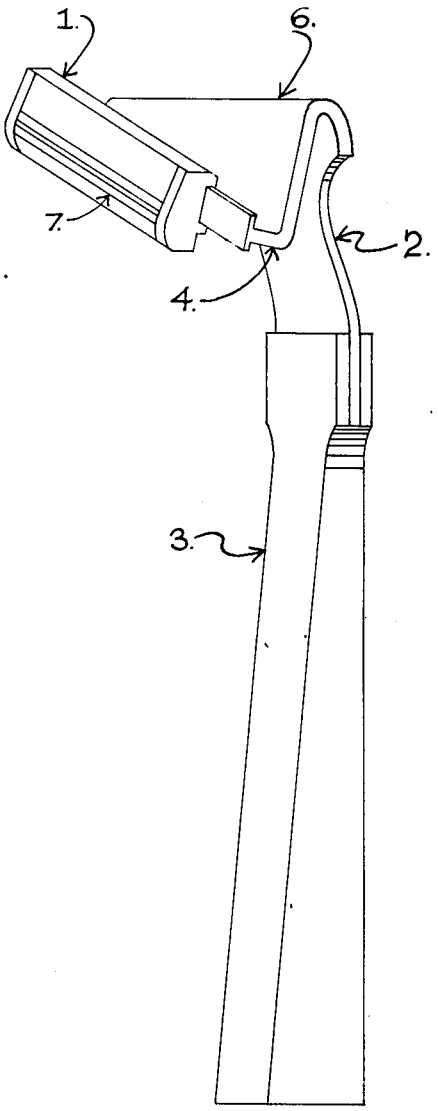
FIG. 5 is a further perspective view illustrating a cartridge blade being mounted on the handle assembly.

The head 2 is a unitary member which may be molded or formed from sheet material and which has a serpentine-like shape as best shown in FIGS. 2, 4, and 5. The lower end of head 2 is connected to the top end of gripping portion 3 and projects upwardly to a first bend or loop. This first bend defines a surface 6 which extends transversely of the center line of the handle and which forms the upper end of the handle assembly. The remainder of the head then depends from the first bend a distance such that no part of the blade extends above the upper end of the handle assembly, to a second bend formed along an axis which extends at an acute angle with respect to the transverse surface 6. The other end of the head is defined by a narrow lip 4 which extends in parallel to the second bend. This lip 4 is provided with a pair of opposed flanges which form a track for mounting the blade thereon.

Figure 1:
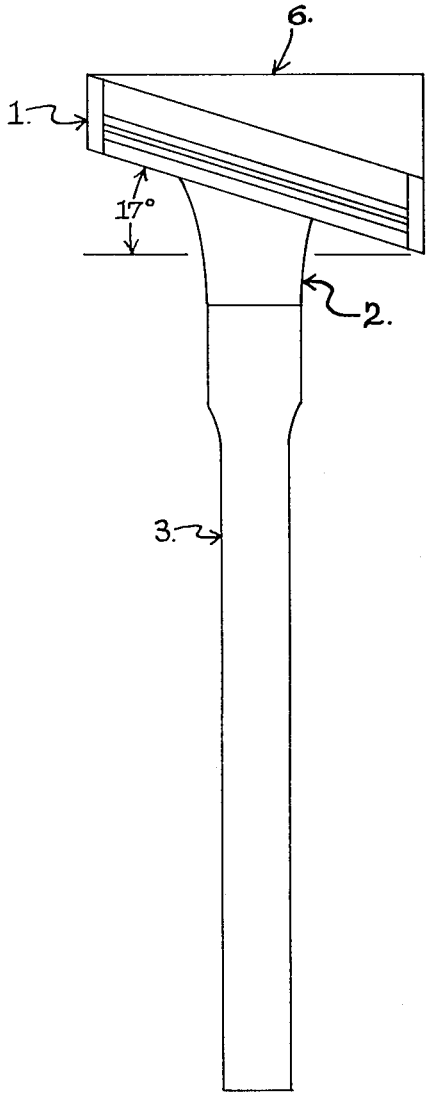
FIG. 1 is a front elevational view of a safety razor according to the present invention.

It is preferred that the cutting edge be positioned at an angle of between 15° and 20° with respect to the upper end of the handle assembly, with 17° being the most preferred angle as shown in FIG. 1. Since most blades are mounted along their longitudinal axes and have cutting edges parallel thereto, the lip 4 extends at an angle of 17° with respect to the transverse surface of the handle assembly. It will, however, be appreciated that where the cutting edge is not parallel to the longitudinal axis of the blade a different angle may be chosen for the second bend and for the lip 4.

Blade 1 is preferably a cartridge blade containing a pair of spaced-apart, parallel blade elements having their cutting edges 7 exposed along one surface of the cartridge. The opposite surface of the cartridge is provided with a slot along its longitudinal axis which enables the cartridge to mate with the flanges of head 2. Finally, since the cartridge is mounted at an angle of 17°, as shown in FIG. 1, a conventional rectangularly-shaped cartridge would have two diagonally opposed edges extending beyond the sides of the head. To avoid this, the cartridge has ends which extend in a perpendicular direction with respect to the transverse surface 6.

Figure 3:
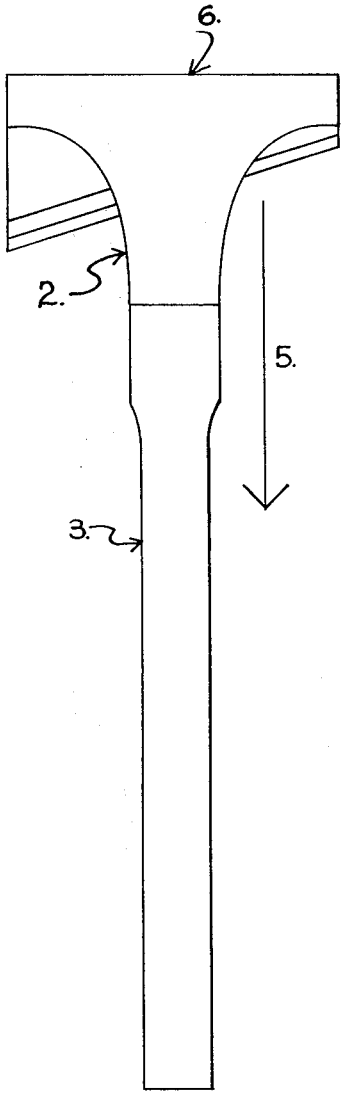
FIG. 3 is a rear elevational view of the safety razor of FIG. 1.

In use, a cartridge is first mated on the opposed flanges of head 2. Because of the particular serpentine-like shape of the head, no part of the inclined blade 1 extends above the transverse surface 6. As shown in FIG. 3, when the user shaves with the safety razor, only the gripping portion and the portion of the head extending up to the transverse upper surface are seen, the inclined blade member being hidden by the contour of the head. The novel cartridge shape also tends to conceal the blade member. Accordingly the user tends to direct the shaving stroke in the direction 5, FIG. 3, relying on the upper transverse surface as a guide. The inclined blade is therefore permitted to slice the hair and a much more comfortable shave results.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended thereto. Thus it is within the scope of the present invention to mold the head and gripping portion as a single element.

What is claimed and desired to be secured by letters patent is:

1. A safety razor comprising a handle assembly and a cartridge including at least one blade element mounted on said handle assembly, said handle assembly including an elongated gripping portion which defines one end of the razor and a head connected to said gripping portion and including a surface which extends transversely with respect to the center line of said gripping portion to define the other end of the razor and means for mounting said cartridge so that no part of said cartridge extends beyond said other end and so that the cutting edge of said blade element extends at an acute angle with respect to said transverse surface in a place substantially parallel to said gripping portion and to said transverse surface and its cutting action is in a direction substantially parallel to the center line of said gripping portion, wherein said head has a serpentine-like shape which defines said transverse surface at a first bend, which depends from said first bend to a second bend and which extends from said second bend to said mounting means.

2. A safety razor according to claim 1, wherein said head and said gripping portion are of unitary, molded construction.

3. A safety razor according to claim 1, wherein said cartridge is positioned on a pair of opposed flanges forming said mounting means.

4. A safety razor according to claim 3, wherein said cartridge is shaped such that its sides extend in a perpendicular direction with respect to said transverse surface when positioned on said opposed flanges.

5. A safety razor according to claim 1, wherein said acute angle is between 15° and 20°.

6. A safety razor according to claim 1, wherein said acute angle is approximately 17°.

7. A safety razor according to claim 1, wherein said cartridge contains a pair of parallel, spaced-apart blade elements.

* * * * *